US008172385B2

(12) United States Patent
Fukushima

(10) Patent No.: US 8,172,385 B2
(45) Date of Patent: May 8, 2012

(54) INK CARTRIDGE AND SEALING MEMBER

(75) Inventor: Takashi Fukushima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/606,100

(22) Filed: Oct. 26, 2009

(65) Prior Publication Data

US 2010/0103232 A1 Apr. 29, 2010

(30) Foreign Application Priority Data

Oct. 27, 2008 (JP) ..... 2008-275665

(51) Int. Cl.
*B41J 2/175* (2006.01)
*B65D 51/16* (2006.01)
*B65D 41/00* (2006.01)

(52) U.S. Cl. ..... 347/86; 220/361; 220/359.1

(58) Field of Classification Search ..... 347/85, 347/86, 87; 206/484.2; 220/359.1, 359.2, 220/359.3, 359.4, 361, 367, 368
See application file for complete search history.

(56) References Cited

U.S. PATENT DOCUMENTS

| | | | | |
|---|---|---|---|---|
| 5,160,320 | A * | 11/1992 | Yum et al. | 604/85 |
| 6,413,599 | B1 * | 7/2002 | Petricca et al. | 428/35.7 |
| 6,431,696 | B1 * | 8/2002 | Tajima et al. | 347/86 |
| 6,899,751 | B2 * | 5/2005 | Arita et al. | 106/31.27 |
| 6,905,769 | B2 * | 6/2005 | Komada | 428/421 |

FOREIGN PATENT DOCUMENTS

| | | | |
|---|---|---|---|
| JP | 409207352 | * | 8/1997 |
| JP | 2000-198116 | | 7/2000 |
| JP | 2002-331688 | | 11/2002 |

* cited by examiner

*Primary Examiner* — Anh T. N. Vo
(74) *Attorney, Agent, or Firm* — Canon USA Inc IP Division

(57) ABSTRACT

A sealing member of an ink cartridge whose casing is formed of a material including an ethylene-propylene random copolymer at least includes a welding layer, an adhesive layer, and a surface layer. The sealing member is also formed of a material including polypropylenes: the welding layer contains an ethylene-propylene random copolymer, and the surface layer contains homopolypropylene oriented by stretching.

11 Claims, 3 Drawing Sheets

INK CARTRIDGE AND SEALING MEMBER

BACKGROUND OF THE INVENTION

1. Field of the Invention

The present invention relates to an ink cartridge that is used in the state of having been installed in an inkjet recording apparatus, and a sealing member that can be welded to an ink cartridge.

2. Description of the Related Art

In general, an ink cartridge for an inkjet recording apparatus includes an ink supply port and an air communication part. Ink can be continuously supplied by supplying the ink through the ink supply port to the recording head of the inkjet recording apparatus and by simultaneously taking the air into the ink cartridge through the air communication part. During shipping of the ink cartridge, the air communication part and the ink supply port are sealed to thereby prevent evaporation or leakage of the ink. Among various methods for sealing the air communication part, there is a method in which a sealing member having good sealing performance such as a film is welded to the casing of the ink cartridge to thereby seal the air communication part. A user of the ink cartridge opens, upon use of the ink cartridge, a portion of the sealing member that seals the air communication part to bring the inside of the ink cartridge into communication with the air.

Such a sealing member is composed of a material that contains silica, alumina, or the like; prevents evaporation of ink; and does not release an environmentally unfriendly substance even when being incinerated. Examples of such a material are described in Japanese Patent Laid-Open No. 2002-331688. Japanese Patent Laid-Open No. 2002-331688 discloses that a packaging material for an ink cartridge is formed by laminating two or more gas-barrier layers of a resin layer to which $SiO_x$ is deposited and a resin layer to which $Al_2O_3$ is deposited. Such lamination of two or more layers enhances the gas barrier property of the packaging material and suppresses evaporation of ink.

The casing of an ink cartridge needs to satisfy the following requirements to store ink therein.

1. having resistance to ink stored therein
2. not altering the composition of ink components
3. having low material cost and low manufacturing cost because ink cartridges are supply items
4. being recyclable because awareness of global environmental problems has been raised
5. having relatively low molding shrinkage
6. being composed of a material having high stiffness An example of a casing material satisfying the above-described requirements is a resin such as modified PPO, PS, PBT, PET, or PP. Among these resins, polypropylene (PP) is suitable in view of a gas barrier property, toughness, resistance to leaching, and cost.

In recent years, environmental problems caused by discarding plastic products such as ink cartridges have received attention, and hence the recyclability of a product is becoming a significant factor to consider as with the functionality of a product. Under these circumstances, attempts to recycle materials have been made in which waste plastic members that are recyclable by appropriate treatments are collected from waste products and recycled as plastic products. For example, Japanese Patent Laid-Open No. 2000-198116 discloses an invention in which collected ink cartridges are recycled as ink cartridges. Specifically, Japanese Patent Laid-Open No. 2000-198116 discloses the following invention: recyclable thermoplastic members are collected, pulverized, and subsequently washed to provide a pulverized mixture; thermoplastic materials are separated from the pulverized mixture; and thermoplastic members equivalent to those collected are produced from the thermoplastic materials.

SUMMARY OF THE INVENTION

Sealing members containing a material such as silica or alumina as described in Japanese Patent Laid-Open No. 2002-331688 have been used for sealing the air communication parts of ink cartridges mainly composed of polypropylene. However, when the resultant ink cartridges are used as materials to be recycled as described in Japanese Patent Laid-Open No. 2000-198116, the material such as alumina or silica contained in sealing members is present in the materials to be recycled. Alumina or silica present in the casing of a recycled ink cartridge leaches into ink and precipitates on an inkjet recording head. This can cause a problem in printing. For this reason, recycling of ink cartridges requires troublesome removal of all such sealing members.

One possible measure to deal with this problem is to use a polypropylene film as a sealing member. However, simple use of a single layer polypropylene film as a sealing member causes the following problems: the sealing member is melted and damaged upon welding; the sealing member sticks to a sealing head with which welding is conducted; the welded sealing member is not readily peeled off neatly; and a sufficiently high gas barrier property is not provided. When the sealing member is not welded so as to seal the air communication part, ink can leak from the air communication part during shipping of the ink cartridge. When the sealing member does not have a sufficiently high gas barrier property, ink evaporates and alters during shipping of the ink cartridge.

Accordingly, the present invention provides an ink cartridge including a highly reliable sealing member that allows easy recycling, prevention of alteration of ink during shipping, and sealing of ink; and such a sealing member.

An ink cartridge according to the present invention includes a casing capable of storing ink to be supplied to an inkjet recording apparatus, the casing being formed of a material including an ethylene-propylene random copolymer; an air communication part provided in the casing; an ink supply port supplying the ink to the inkjet recording apparatus; and a sealing member welded to the casing such that the sealing member covers and seals the air communication part and peeling off of a portion of the sealing member from the casing allows introduction of air through the air communication part into the casing, wherein the sealing member includes a welding layer, an adhesive layer, and a surface layer, and wherein the welding layer contains an ethylene-propylene random copolymer, the surface layer contains homopolypropylene oriented by stretching, and the surface layer has a melting point higher than a melting point of the welding layer.

The present invention also provides a sealing member of an ink cartridge including a casing capable of storing ink to be supplied to an inkjet recording apparatus, the casing being formed of a material including an ethylene-propylene random copolymer; an air communication part provided in the casing; and an ink supply port supplying the ink to the inkjet recording apparatus, the sealing member being welded to the casing such that the sealing member covers and seals the air communication part and peeling off of a portion of the sealing member from the casing allows introduction of air through the air communication part into the casing, the sealing member including a welding layer, an adhesive layer, and a surface layer, wherein the welding layer contains an ethylene-propylene random copolymer, the surface layer contains homopolypropylene oriented by stretching, and the surface layer has a melting point higher than a melting point of the welding layer.

As described above, the sealing member contains homopolypropylene oriented by stretching in the surface layer and an ethylene-propylene random copolymer in the welding layer. Thus, the sealing member is mainly composed of propylene-based materials as in the casing of the ink cartridge. When the air communication part of the ink cartridge is sealed with this sealing member, the ink cartridge can be used as a material to be recycled without removing the sealing member.

As described above, the sealing member includes a layer oriented by stretching and also includes a stack of a plurality of layers. As a result, evaporation of ink through the sealing member is suppressed and hence ink can be maintained without being altered.

By forming the surface layer to have a melting point higher than that of the welding layer and welding the sealing member to the casing at a temperature of less than the melting point of the surface layer and more than the melting point of the welding layer, the welding layer of the sealing member is welded to the casing but the surface layer is not welded. Thus, the sealing member is not damaged or does not stick to a sealing head. Therefore, an ink cartridge including a highly reliable sealing member and such a sealing member can be provided.

Further features of the present invention will become apparent from the following description of exemplary embodiments with reference to the attached drawings.

DESCRIPTION OF THE EMBODIMENTS

Figure 1:
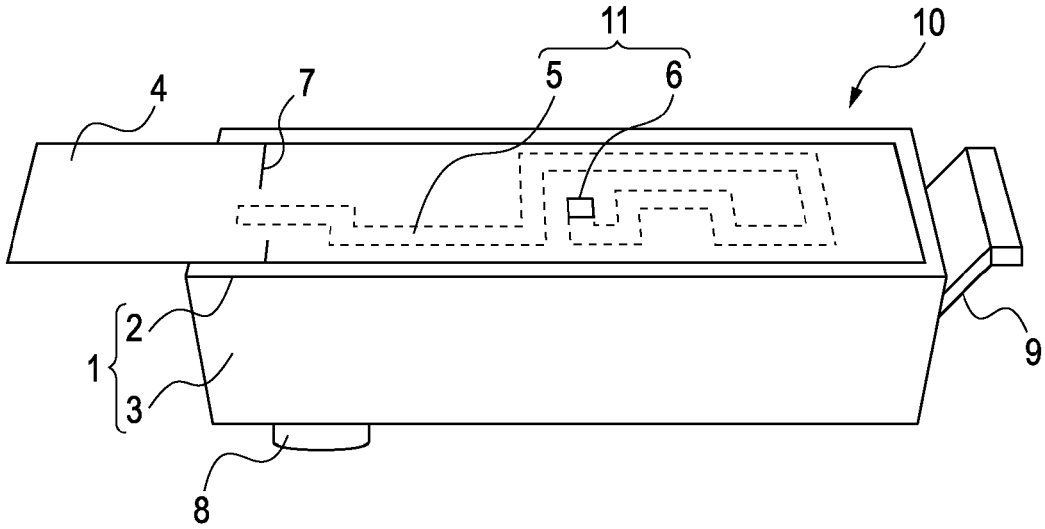
FIG. 1 is a schematic perspective view of an ink cartridge according to an embodiment of the present invention.

A casing of an ink cartridge capable of storing ink includes an air communication part for introducing air into the casing, and an ink supply port supplying ink to an inkjet recording head that ejects the ink. During shipping of such an ink cartridge, the casing is kept under sealed conditions by sealing the air communication part and the ink supply port to thereby prevent ink leakage. The air communication part is sealed by welding a sealing member to the casing. When the ink cartridge is used, the ink supply port and the air communication part are brought into communication with the air and the ink cartridge is installed in an inkjet recording apparatus. The casing of the ink cartridge is configured to maintain the internal pressure of the ink cartridge constant by taking the air into the casing through the air communication part such that ink ejected through the ink supply port is compensated.

The welding of a sealing member is conducted by temporarily placing or temporarily welding the sealing member onto an ink cartridge and subsequently pressing the sealing member to the ink cartridge with a high-temperature plate referred to as a sealing head. In this welding, heat is conducted through the sealing member to the ink cartridge and a portion of the sealing member and a portion of the casing of the ink cartridge are melted. As a result, the sealing member is welded to the casing.

As described above, the casing of an ink cartridge needs to satisfy, for example, the following requirements to stably store ink therein.

1. having resistance to ink stored therein
2. not altering the composition of ink components
3. having low material cost and low manufacturing cost because ink cartridges are supply items
4. being recyclable because awareness of global environmental problems has been raised
5. having relatively low molding shrinkage
6. being composed of a material having high stiffness When the casing has transparency, a prism may be formed in a portion of the casing and the amount of ink remaining can be determined with the prism. Suitable materials for satisfying the above-described requirements are polypropylene materials. Among polypropylenes, an ethylene-propylene random copolymer is desirable as a material for an ink cartridge that is required to be positioned accurately because an ethylene-propylene random copolymer has high transparency and low molding shrinkage compared with a propylene homopolymer and a propylene block copolymer. For this reason, an ethylene-propylene random copolymer is used for the casing of an ink cartridge in the present invention. Such a casing can be produced by welding a plurality of members together. When the casing of an ink cartridge is produced by combining a plurality of members together, an component such as an absorber capable of storing ink therein can be readily placed in the casing. In such a case where the casing of an ink cartridge is produced by combining a plurality of members together, the air communication part of the casing can be sealed by welding a sealing member to one of the plurality of members.

A material for such a sealing member needs to satisfy, for example, the following requirements: being recyclable, having a gas barrier property for suppressing evaporation of ink, having resistance to ink such that contact with the ink for a long period of time does not alter the material, and having the capability of being welded to an ink cartridge. In an embodiment of the present invention, a sealing member is mainly composed of polypropylenes as in an ink cartridge. Polypropylenes are divided into homopolymers produced by polymerizing monomers of a single type, and random copolymers and block copolymers produced by polymerizing monomers of two or more types. Polypropylene films can be made to have enhanced chemical resistance or an enhanced water-vapor barrier property by stretching the films.

When a single-layer polypropylene film is used as a sealing member and welded to a casing, the following problems can occur: the sealing member is melted to have surface roughness, the sealing member sticks to a sealing head, the sealing member has an excessively high peel strength, or ink evaporates through the sealing member. For these reasons, a sealing member is at least constituted by three layers (a surface layer, an adhesive layer, and a welding layer) as a result of laminating two polypropylene films. To enhance a gas barrier property, a sealing member desirably further includes another polypropylene film between the surface layer and the welding layer and is thus constituted by five layers (a surface layer, an adhesive layer, an intermediate layer, an adhesive layer, and a welding layer). Descriptions of the content of an ink cartridge or the like may be printed on the polypropylene films. An adhesive used for such an adhesive layer is not particularly restricted and a urethane-based adhesive, an epoxy-based adhesive, an acrylic-based adhesive, or the like may be used.

In particular, a urethane-based adhesive that has high adhesion to polypropylene is desirably used.

When a sealing member has too large a thickness, the sealing member becomes rigid and it becomes difficult to peel off the sealing member from the casing. In contrast, when a sealing member has too small a thickness, the sealing member has a poor gas barrier property and a poor welding property. For these reasons, a sealing member desirably has a thickness of about 40 μm to 120 μm.

The surface layer is composed of homopolypropylene oriented by stretching, has excellent heat resistance, and has a melting point of about 170° C. Being oriented by stretching enhances a gas barrier property and the effect of suppressing evaporation of ink from an ink cartridge. Homopolypropylene oriented by stretching also has high flatness and a printing substrate composed of such homopolypropylene allows good printing. Use of biaxially oriented homopolypropylene for the surface layer allows a user to easily peel off the resultant sealing member along a scored line.

The welding layer is composed of an ethylene-propylene random copolymer, which is one of polypropylenes. The ethylene-propylene random copolymer has a melting point of about 140° C., which is lower than that of homopolypropylene used for the surface layer. The welding of a sealing member is desirably conducted in the temperature range of 140° C. to 170° C. in which the welding layer and the casing are melted and welded together but the surface layer is not melted, more desirably, in the temperature range of about 150° C. to 160° C. As described above, by forming a surface layer with a material having a melting point higher than that of a welding layer and conducting the welding at a temperature of less than the melting point of the surface layer and more than the melting point of the welding layer, the welding layer is welded to the casing but the surface layer is not welded. As a result, the sealing member can be welded to the casing of an ink cartridge without being damaged or sticking to a sealing head.

When the welding strength of a sealing member is too low, the sealing member may peel off due to stress caused by temperature variation, strong vibration, or strong impact. In contrast, when the welding strength of a sealing member is too high, the sealing member may be peeled off not at the boundary between the casing and the welding layer but at the boundary, for example, between the surface layer and the welding layer and, as a result, there is a possibility that the air communication part is not brought into communication with the air. For this reason, the peel strength of the welding layer is desirably about 7 to 40 N when the welding layer is peeled off with a push-pull gauge at a rate of 165 mm/sec in the direction perpendicular to the plane where the sealing member is welded. To achieve such a peel strength, the composition of the welding layer is adjusted by adding a polyethylene component that has properties similar to those of polypropylene. Addition of polyethylene results in a sea-island structure in which an ethylene-propylene random copolymer layer is dotted with polyethylene. Since this polyethylene has low compatibility with an ethylene-propylene random copolymer, the portions of the sea-island structure corresponding to the polyethylene have low peel strength. As a result, the welding layer can be adjusted to have a suitable peel strength.

However, when an ink cartridge including such a sealing member is used as a material for producing a recycled ink cartridge, polyethylene in the sealing member enters the recycled ink cartridge. Since polyethylene has low compatibility with an ethylene-propylene random copolymer, polyethylene and the ethylene-propylene random copolymer are separated from each other. As a result, an increase in the amount of polyethylene in an ethylene-propylene random copolymer degrades the properties of the ethylene-propylene random copolymer, and cartridges satisfying the above-described requirements cannot be produced. The weight of polyethylene that does not cause problems in the casing of a recycled ink cartridge is 5 wt % or less, desirably 1 wt % or less, based on the entire weight of the ink cartridge. When the amount of polyethylene contained in a film is 1 wt % or less based on the entire weight of an ink cartridge, a recycling material of quality as high as that of a virgin material can be obtained. If necessary, addition of a compatibilizer can enhance the compatibility between polyethylene and an ethylene-propylene random copolymer.

When the intermediate layer is formed, the intermediate layer is desirably composed of homopolypropylene oriented by stretching as in the surface layer. When a scored line is formed in a sealing member, use of biaxially oriented homopolypropylene for the intermediate layer allows a user to easily peel off the sealing member along the scored line.

The intermediate layer enhances the gas barrier property of the sealing member and allows a user to easily peel off the sealing member. The intermediate layer also reduces distortion or warpage due to residual stress generated upon the production of the sealing member. The occurrence of distortion or warpage in a sealing member upon the production of the sealing member causes errors in the cutting of the sealing member on production lines or welding defect. For this reason, distortion or warpage is desirably minimized.

Hereinafter, embodiments according to the present invention are described in detail. However, the technical scope of the present invention is not restricted to these embodiments.

Figure 2:
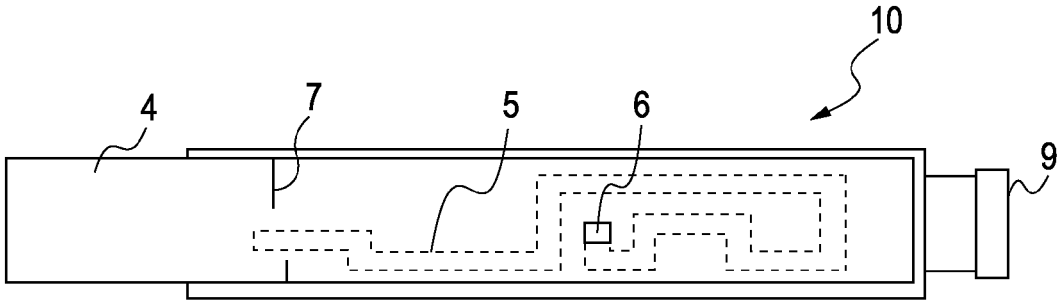
FIG. 2 is a top view of the ink cartridge shown in FIG. 1.
Figure 3:
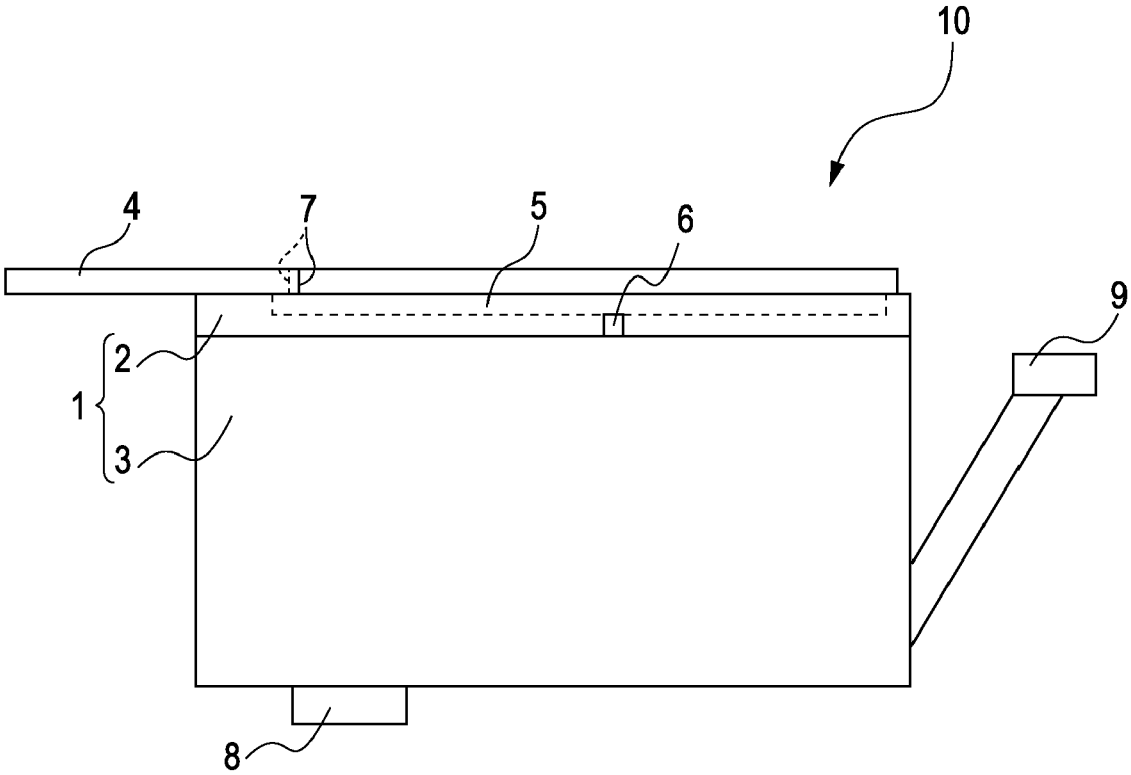
FIG. 3 is a side view of the ink cartridge shown in FIG. 1.

FIG. 1 is a perspective view of an ink cartridge according to a first embodiment of the present invention. FIG. 2 is a top view of the ink cartridge shown in FIG. 1. FIG. 3 is a side view of the ink cartridge shown in FIG. 1. An ink cartridge 10 according to the first embodiment contains an absorber for being impregnated with ink and storing the ink. A casing 1 has an ink supply port 8 supplying ink to a recording head. To prevent leakage or evaporation of ink from the ink supply port 8, the ink cartridge 10 is packaged and shipped in the state of being equipped with a cap (not shown) covering the ink supply port 8. The casing 1 is constituted by a lid member 2 and an ink storage member 3 that are welded together. By constituting the casing 1 by these two members, the absorber for storing ink can be readily placed in the casing 1. The lid member 2 has a recess and a sealing member 4 is welded so as to cover the entire recess. In the first embodiment, an air communication part 11 includes an air communication path 5 and an air communication port 6. The air communication path 5 is provided by sealing the recess of the lid member 2 with the sealing member 4. The air communication port 6 extending through the casing 1 is provided at an end of the air communication path 5. During shipping of the ink cartridge 10, the air communication part 11 is sealed to thereby prevent leakage or evaporation of ink. Prior to the installation of the ink cartridge 10 in an inkjet recording apparatus, peeling off of a portion of the sealing member 4 constituting the air communication path 5 allows the air to pass through the air communication port 6. When ink is supplied to an inkjet recording head through the ink supply port 8, the air enters the ink cartridge 10 through the air communication port 6 to thereby maintain the internal pressure of the ink cartridge 10 constant. The sealing member 4 includes a scored portion 7. A desired area of the sealing member 4 can be peeled off with the scored portion 7. When the peeled-off area of the sealing member 4 is too large, ink evaporates excessively and the viscosity of the ink may increase during use of the ink cartridge 10. When the sealing member 4 is peeled off along the scored portion 7, only a portion of the air communication path 5 is exposed to the air to thereby suppress evaporation of ink being used. The casing 1 is equipped with a lever 9 that facilitates installation and removal of the ink cartridge 10 to/from the inkjet recording apparatus.

Figure 4:
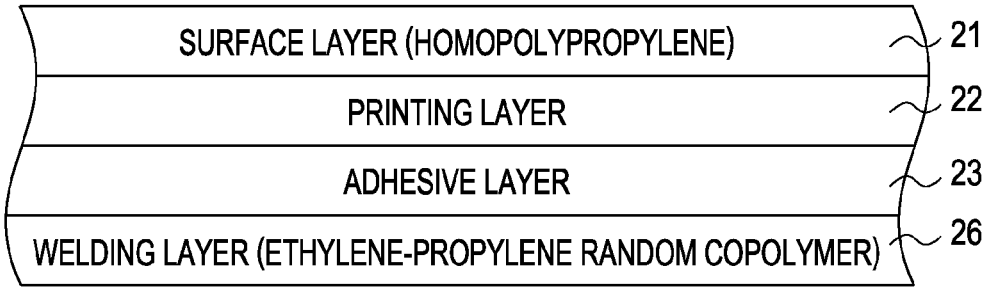
FIG. 4 shows the configuration of a sealing member according to a first embodiment.

FIG. 4 shows the configuration of the sealing member 4 according to the first embodiment. The sealing member 4 is constituted by a surface layer 21, a printing layer 22, an adhesive layer 23, and a welding layer 26. The surface layer 21 is composed of biaxially oriented homopolypropylene and has a thickness of 40 μm. The printing layer 22 is provided by printing, onto the surface layer 21, for example, descriptions of a content to be stored in the casing 1 to which the sealing member 4 is to be welded. The adhesive layer 23 is composed of a urethane-based adhesive that is suitable for adhesion to polypropylene. The welding layer 26 is composed of a non-stretched ethylene-propylene random copolymer and has a thickness of 20 μm. The welding layer 26 contains 30 wt % polyethylene based on the ethylene-propylene random copolymer. This amount of polyethylene corresponds to 1 wt % or less based on the entire weight of the ink cartridge 10. Addition of polyethylene permits a user to readily peel off the sealing member 4 from the casing 1. The lid member 2 and the ink storage member 3 of the casing 1 are composed of an ethylene-propylene random copolymer. Thus, since the sealing member 4 is composed of polypropylenes as in the casing 1 of the ink cartridge 10, the ink cartridge 10 being no longer used can be used as a material to be recycled without removing the sealing member 4. Since the amount of polyethylene added to the sealing member 4 is 1 wt % or less based on the entire weight of the ink cartridge 10, use of the ink cartridge 10 as a material to be recycled without removing the sealing member 4 does not degrade the quality of a recycled ink cartridge 10. Since the sealing member 4 is produced by laminating two polypropylene films so as to include a layer oriented by stretching, the sealing member 4 has a high gas barrier property and alteration of ink can be suppressed.

The sealing member 4 is formed by laminating, with a roller, the welding layer 26 onto which the adhesive layer 23 is transferred, and the surface layer 21 on the back surface of which printing is conducted. The thus-formed sealing member 4 is placed on the lid member 2 of the casing 1 and pressed to the lid member 2 with a sealing head at 160° C. for 3 seconds. Thus, the sealing member 4 is welded to the casing 1. As described above, the homopolypropylene of the surface layer 21 has a melting point of about 170° C. while the ethylene-propylene random copolymer of the welding layer 26 and the casing 1 has a melting point of 140° C. As described above, by forming the surface layer 21 with a material having a melting point higher than that of the welding layer 26 and conducting the welding at a temperature of less than the melting point of the surface layer 21 and more than the melting point of the welding layer 26, the welding layer 26 is welded to the casing 1 but the surface layer 21 is not welded. As a result, the sealing member 4 can be welded to the casing 1 of the ink cartridge 10 without being damaged or sticking to the sealing head.

Figure 5:
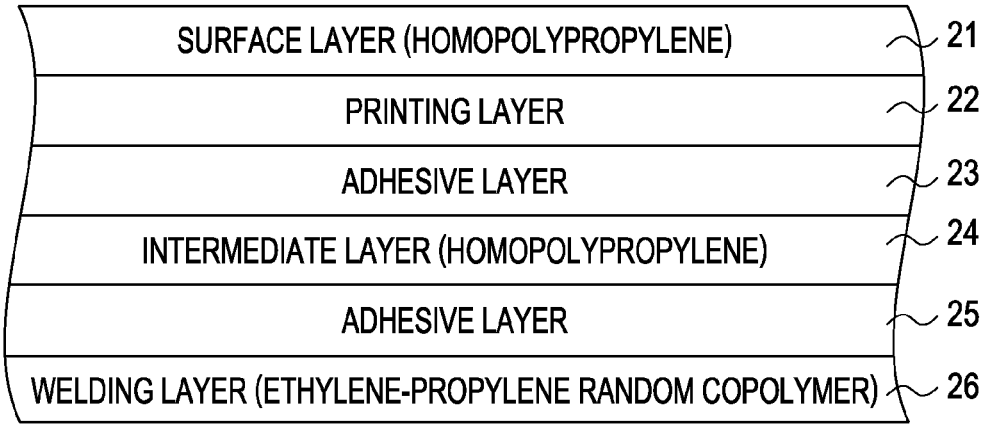
FIG. 5 shows the configuration of a sealing member according to a second embodiment.

Another configuration of the sealing member 4 according to a second embodiment of the present invention will be described with reference to FIG. 5, the sealing member 4 also being weldable to the casing 1 as in the first embodiment. The sealing member 4 is constituted by a surface layer 21, a printing layer 22, an adhesive layer 23, an intermediate layer 24, an adhesive layer 25, and a welding layer 26. The surface layer 21 is composed of biaxially oriented homopolypropylene and has a thickness of 40 μm. The printing layer 22 is provided by printing, onto the surface layer 21, for example, descriptions of a content to be stored in the casing 1 to which the sealing member 4 is to be welded. The adhesive layers 23 and 25 are composed of a urethane-based adhesive that is suitable for adhesion to polypropylene. The intermediate layer 24 is composed of biaxially oriented homopolypropylene and has a thickness of 20 μm. In this way, use of a stack of biaxially oriented homopolypropylene can further enhance the gas barrier property of the sealing member 4 and alteration of ink can be further suppressed. The welding layer 26 is composed of a non-stretched ethylene-propylene random copolymer and has a thickness of 20 μm. The welding layer 26 contains 30 wt % polyethylene based on the ethylene-propylene random copolymer. This amount of polyethylene corresponds to 1 wt % or less based on the entire weight of the ink cartridge 10. Addition of polyethylene permits a user to readily peel off the sealing member 4 from the casing 1. The lid member 2 and the ink storage member 3 of the casing 1 are composed of the ethylene-propylene random copolymer. Thus, since the sealing member 4 is composed of polypropylenes as in the casing 1 of the ink cartridge 10, the ink cartridge 10 being no longer used can be used as a material to be recycled without removing the sealing member 4. Since the amount of polyethylene added to the sealing member 4 is 1 wt % or less based on the entire weight of the ink cartridge 10, use of the ink cartridge 10 as a material to be recycled without removing the sealing member 4 does not degrade the quality of a recycled ink cartridge 10.

The sealing member 4 is formed by laminating, with a roller, the welding layer 26 onto which the adhesive layer 25 is transferred with a roller, the intermediate layer 24 onto which the adhesive layer 23 is transferred, and the surface layer 21 on the back surface of which printing is conducted. The thus-formed sealing member 4 is placed on the lid member 2 of the casing 1 and pressed to the lid member 2 with a sealing head at 160° C. for 3 seconds. Thus, the sealing member 4 is welded to the casing 1. As described above, the homopolypropylene of the surface layer 21 and the intermediate layer 24 has a melting point of about 170° C. while the ethylene-propylene random copolymer of the welding layer 26 and the casing 1 has a melting point of 140° C. As described above, by forming the surface layer 21 and the intermediate layer 24 with a material having a melting point higher than that of the welding layer 26 and conducting the welding at a temperature of less than the melting point of the surface layer 21 and the intermediate layer 24 and more than the melting point of the welding layer 26, the welding layer 26 is welded to the casing 1 but the surface layer 21 and the intermediate layer 24 are not welded. As a result, the sealing member 4 can be welded to the casing 1 of the ink cartridge 10 without being damaged or sticking to the sealing head.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-275665 filed Oct. 27, 2008, which is hereby incorporated by reference herein in its entirety.

What is claimed is:

1. An ink cartridge comprising:

a casing capable of storing ink to be supplied to an inkjet recording apparatus, the casing comprised of an ethylene-propylene random copolymer;

an air communication part provided in the casing; and a sealing member welded to the casing such that the sealing member seals the air communication part, wherein the sealing member includes a welding layer comprised of an ethylene-propylene random copolymer and a surface layer comprised of homopolypropylene oriented by stretching, and the surface layer has a melting point higher than a melting point of the welding layer.

2. The ink cartridge according to claim 1, wherein the sealing member includes an intermediate layer between the welding layer and the surface layer, and the intermediate layer comprised of homopolypropylene oriented by stretching.

3. The ink cartridge according to claim 1, wherein the casing includes a plurality of members, and the sealing member is welded to one of the plurality of members.

4. The ink cartridge according to claim 1, wherein the sealing member is welded to the casing at a temperature between the melting point of the surface layer and the melting point of the welding layer.

5. The ink cartridge according to claim 1, wherein the sealing member is welded to the casing at a temperature in the range of 150° C. to 160° C.

6. The ink cartridge according to claim 1, wherein the ethylene-propylene random copolymer of the welding layer comprised of polyethylene.

7. A sealing member of an ink cartridge including a casing capable of storing ink to be supplied to an inkjet recording apparatus, the casing comprised of an ethylene-propylene random copolymer;

an air communication part provided in the casing;

the sealing member being welded to the casing such that the sealing member covers and seals the air communication part wherein the sealing member includes a welding layer comprised of an ethylene-propylene random copolymer and a surface layer comprised of homopolypropylene oriented by stretching, and the surface layer has a melting point higher than a melting point of the welding layer.

8. The sealing member according to claim 7, wherein the sealing member includes an intermediate layer between the welding layer and the surface layer, and the intermediate layer comprised of homopolypropylene oriented by stretching.

9. The sealing member according to claim 7, wherein the sealing member is welded to the casing at a temperature between the melting point of the surface layer and the melting point of the welding layer.

10. The sealing member according to claim 7, wherein the sealing member is welded to the casing at a temperature in the range of 150° C. to 160° C.

11. The sealing member according to claim 7, wherein the ethylene-propylene random copolymer of the welding layer comprised of polyethylene.

* * * * *